US010654107B2

(12) United States Patent
Manuel et al.

(10) Patent No.: US 10,654,107 B2
(45) Date of Patent: May 19, 2020

(54) METHOD FOR PRODUCING NANOPARTICLES AND THE NANOPARTICLES PRODUCED THEREFROM

(71) Applicants: University of Florida Research Foundation, Inc., Gainesville, FL (US); UTBATTELLE, LLC, Oak Ridge, TN (US)

(72) Inventors: Michele Viola Manuel, Gainesville, FL (US); Hunter B. Henderson, Gainesville, FL (US); Orlando Rios, Oak Ridge, TN (US); Gerard M. Ludtka, Oak Ridge, TN (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 16/394,531

(22) Filed: Apr. 25, 2019

(65) Prior Publication Data

US 2019/0321893 A1 Oct. 24, 2019

Related U.S. Application Data

(62) Division of application No. 15/123,172, filed as application No. PCT/US2015/018690 on Mar. 4, 2015, now Pat. No. 10,343,219.

(Continued)

(51) Int. Cl.
*B22F 9/06* (2006.01)
*B22F 1/00* (2006.01)

(Continued)

(52) U.S. Cl.
CPC ..... *B22F 9/06* (2013.01); *B22F 1/0018* (2013.01); *B22F 1/0044* (2013.01);

(Continued)

(58) Field of Classification Search
CPC ..... C25D 15/00; C25D 1/00; C22C 1/084; B22F 9/06; B22F 1/0018; B22F 1/0044;

(Continued)

(56) References Cited

U.S. PATENT DOCUMENTS 5,665,277 A 9/1997 Johnson et al.
2003/0115988 A1 6/2003 Pozarnsky et al.

(Continued)

FOREIGN PATENT DOCUMENTS

CN 1109022 A 9/1995
CN 101956120 A 1/2011

(Continued)

OTHER PUBLICATIONS

International Search Report for PCT/US2015/018690 dated Jun. 3, 2015.

(Continued)

*Primary Examiner* — Tima M. McGuthry-Banks
(74) *Attorney, Agent, or Firm* — Thomas|Horstemeyer, LLP

(57) ABSTRACT

Disclosed herein is a method comprising disposing a container containing a metal and/or ferromagnetic solid and abrasive particles in a static magnetic field; where the container is surrounded by an induction coil; activating the induction coil with an electrical current, to heat up the metallic or ferromagnetic solid to form a fluid; generating sonic energy to produce acoustic cavitation and abrasion between the abrasive particles and the container; and producing nanoparticles that comprise elements from the container, the metal and/or the ferromagnetic solid and the abrasive particles. Disclosed herein too is a composition comprising first metal or a first ceramic; and particles comprising carbides and/or nitrides dispersed therein. Disclosed herein too is a composition comprising nanoparticles (Continued)

comprising chromium carbide, iron carbide, nickel carbide, γ-Fe and magnesium nickel.

17 Claims, 5 Drawing Sheets

Related U.S. Application Data

(60) Provisional application No. 61/947,603, filed on Mar. 4, 2014.

(51) Int. Cl.

| | |
|---|---|
| ***C22C 1/10*** | (2006.01) |
| ***C25D 1/00*** | (2006.01) |
| ***C25D 15/00*** | (2006.01) |
| ***B22F 9/04*** | (2006.01) |

(52) U.S. Cl.
CPC ..... *C22C 1/1084* (2013.01); *C25D 1/00* (2013.01); *C25D 15/00* (2013.01); *B22F 2009/042* (2013.01); *B22F 2202/01* (2013.01); *B22F 2202/07* (2013.01); *B22F 2301/058* (2013.01); *B22F 2302/10* (2013.01); *B22F 2302/20* (2013.01); *B22F 2998/10* (2013.01); *B22F 2999/00* (2013.01)

(58) Field of Classification Search
CPC ..... B22F 2202/01; B22F 2202/07; B22F 2301/058; B22F 2302/10; B22F 2302/20; B22F 2998/10; B22F 2999/00
See application file for complete search history.

(56) References Cited

U.S. PATENT DOCUMENTS

| | | | | |
|---|---|---|---|---|
| 2004/0101467 | A1 | 5/2004 | Harutyunyan et al. | |
| 2013/0119296 | A1 | 5/2013 | Ludtka et al. | |
| 2013/0210610 | A1 | 8/2013 | Veith et al. | |
| 2016/0199907 | A1 * | 7/2016 | Jarvis ..... | B22D 1/00 75/10.67 |

FOREIGN PATENT DOCUMENTS

| | | | |
|---|---|---|---|
| CN | 102146573 | B | 5/2013 |
| WO | WO 2015028065 | A1 * | 3/2015 |

OTHER PUBLICATIONS

Translation of the Abstract for CN1109022 published on Sep. 27, 1995.
Translation of the Abstract for CN101956120 published on Jan. 26, 2011.
Translation of the Abstract for CN102146573 published on May 8, 2013.

* cited by examiner

METHOD FOR PRODUCING NANOPARTICLES AND THE NANOPARTICLES PRODUCED THEREFROM

CROSS-REFERENCE TO RELATED APPLICATIONS

This application is a divisional of co-pending U.S. application Ser. No. 15/123,172, filed Sep. 1, 2016, currently granted: which application is the 35 U.S.C. § 371 national stage application of PCT Application No. PCT/US2015/018690, filed Mar. 4, 2015, where the PCT claims priority to and the benefit of, U.S. Provisional Application No. 61/947,603, filed Mar. 4, 2014, the contents of each of which applications are herein incorporated by reference in their entirety.

STATEMENT REGARDING FEDERALLY SPONSORED RESEARCH OR SUPPORT

This invention was made with Government support under grant number DE-AC05-00OR22725 awarded by the U.S. Department of Energy/National Energy Technology Laboratory (NETL) and under Grant number DMR0845868 awarded by the National Science Foundation. The Government has certain rights in this invention.

BACKGROUND

This disclosure relates to a method for producing nanoparticles from a solid and to the nanoparticles produced therefrom. This disclosure also relates to composites that contain the nanoparticles produced therefrom.

In recent decades, nanoparticles have received an enormous amount of scientific attention due to their novel behavior and industrial applications, from quantum dots to catalysis. Synthesis of nanoparticles can be challenging, since they exist far from equilibrium with a high surface to volume ratio. Modern inorganic nanoparticles are generally produced by the decomposition of organic precursors, either by a sol-gel process or by pyrolysis. These methods have proven effective, but attainable nanoparticle chemistries are limited by the availability of appropriate precursors and corresponding decomposition reactions. A more chemically flexible nanoparticle production approach is mechanical attrition of a bulk material into small particles in a "top down" approach. Processing by rotary mills is the most common technique to form particles by attrition, but new techniques may be needed to produce new chemistries.

Engineered clusters of thermally or environmentally activated reactive micron-scale particles with fast reaction kinetics such a thermites have been shown to effectively produce nano-particles in a low-solubility matrix. However, the stability of reactive powders impedes implementation of this technology. To this end, cavitation erosion of a surface is investigated as a particle generation mechanism, along with a surface morphology-changing reaction that may change the mechanics of cavitation erosion.

Processes that suspend nanoparticles in solution can be advantageous from the prospective of safety and efficacy. Recent papers on particle safety indicate that nanoparticles can be highly hazardous to humans and persist in the environment. However, if particles are formed in an insoluble solution by an in-situ method, the airborne release of particles is minimized, lessening environmental contamination and respiratory distress, while concurrently hindering agglomeration. The addition of cavitation to this methodology can enhance in-situ particle formation. Cavitation can potentially enhance the wettability of particles, and the combination of cavitation and in-situ formation creates individual particles that are wetted to the melt, thus reducing tendency for agglomeration. However, the use of solvents (for the solution) necessitates the use of additional processing steps such as, for example, drying, in addition to disposing of the solvents.

It is desirable to find new methods to produce nanoparticles that do not have some of the aforementioned drawbacks.

SUMMARY

Disclosed herein is a method comprising disposing a container containing a metal and/or ferromagnetic solid and abrasive particles in a static magnetic field; where the container is surrounded by an induction coil; activating the induction coil with an electrical current, to heat up the metallic or ferromagnetic solid to form a fluid; generating sonic energy to produce acoustic cavitation and abrasion between the abrasive particles and the container; and producing nanoparticles that comprise elements from the container, the metal and/or the ferromagnetic solid and the abrasive particles.

Disclosed herein too is a composition comprising a first metal or a first ceramic; and particles comprising carbides and/or nitrides dispersed therein.

Disclosed herein too is a composition comprising nanoparticles comprising chromium carbide, iron carbide, nickel carbide, γ-Fe and magnesium nitride.

Disclosed too are articles manufactured from the foregoing compositions.

BRIEF DESCRIPTION OF THE FIGURES

FIG. 2 (B) is a temperature and static magnetic field profile of the MAMT process;

FIGS. 2(C)-2(E) show the three stages of MAMT which include (C) heating and ramping field, (DE) isothermal hold at high field during with acoustic melt treatment, and (E) helium quench and static field ramp down;

FIG. 5 (B) is a scanning transmission electron micrograph-annular dark field (STEM-ADF) image of nanoparticles in Sample SP; and FIGS. 5 (C) and (D) show energy dispersive xray spectra (EDS) line-scans of a particle in B showing that the particle is primarily nickel and iron.

DETAILED DESCRIPTION

Disclosed herein is a method of manufacturing particles using acoustic cavitation produced in a magnetic field. The method comprises disposing in a magnetic field a container that contains an electrically conducting fluid and abrasive particles. It is desirable that the abrasive particles contain carbon. In another embodiment, carbonaceous particles may be added in addition to the abrasive particles to the electrically conducting fluid. The electrically conducting fluid is preferably a metallic fluid but can also be a ferromagnetic fluid.

The methods used for producing the acoustic cavitation is termed electromagnetic acoustic induction (EMAT). Another method for producing acoustic cavitation is known as magneto-acoustic mixing technology (MAMT).

Electromagnetic acoustic transduction (EMAT) uses a transducer for non-contact sound generation and reception using electromagnetic mechanisms. EMAT is an ultrasonic nondestructive testing (NDT) method which does not use a contact or a couplant, because the sound is directly generated within the material adjacent to the transducer. EMAT is an ideal transducer to generate Shear Horizontal (SH) bulk wave mode, Surface Wave, Lamb waves and all sorts of other guided-wave modes in metallic and/or ferromagnetic materials.

The method is advantageous in that it can be used to produce metallic nanoparticles and microparticles from the material that is used to manufacture the container. In another embodiment, the method can be used to produce alloy nanoparticles and microparticles that contain ingredients from the abrasive particles, the electrically conducting fluid and the container. This disclosure relates to a novel nanoparticle fabrication methodology: combining reaction and acoustic cavitation abrasion of a solid interface next to a liquid. Magneto-Acoustic Mixing Technology (MAMT) is used to produce nanoparticles by chemical and acoustic mechanisms between diamond particles and a stainless steel surface in the presence of a liquid metal (such as for example magnesium). This method exhibits a number of advantages, including fabrication of novel chemistries and continuous particle production. This methodology is also easily adaptable to an in-situ nanoparticle generation mechanism for the production of metal matrix nanocomposites (MMnCs). In-situ particle generation methods like MAMT inherently limit particle agglomeration and improve the safety of nanocomposite fabrication by eliminating environmental contamination.

Figure 1:
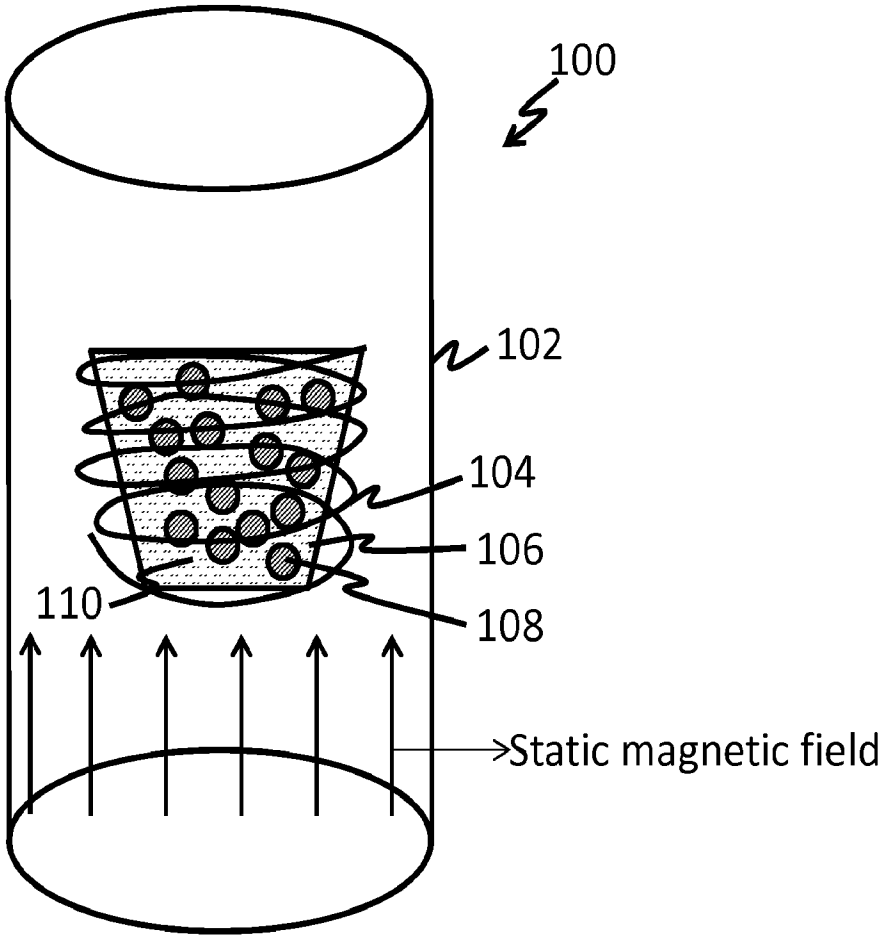
FIG. 1 is a schematic of an exemplary set-up for producing nanoparticles.

FIG. 1 is a depiction of an exemplary schematic production set-up in which the nanoparticles are produced. The set-up 100 comprises a magnet 102 (having a bore) in which is located a container 106 that contains an electrically conducting metallic or ferromagnetic fluid 110. The metallic or ferromagnetic fluid 110 is initially in the form of a solid. The container 106 is preferably manufactured from a metal or a ceramic. The container 106 contains abrasive particles 108. An induction coil 104 surrounds the container 106.

Upon activating the induction coil with an electrical current, a magnetic field is set up in the container. Induction heating in the container heats up the metallic or ferromagnetic solid to form a fluid 100. Sonic energy generated as a result of the induced magnetic field produces acoustic cavitation and produces abrasion between the abrasive particles and the container. In addition, carbon contained in the abrasive particles diffuses into the container to produce carbides. Reactions may also take place between the elements of the metallic or ferromagnetic fluid and the elements of the container to produce a variety of alloys.

Figure 2:
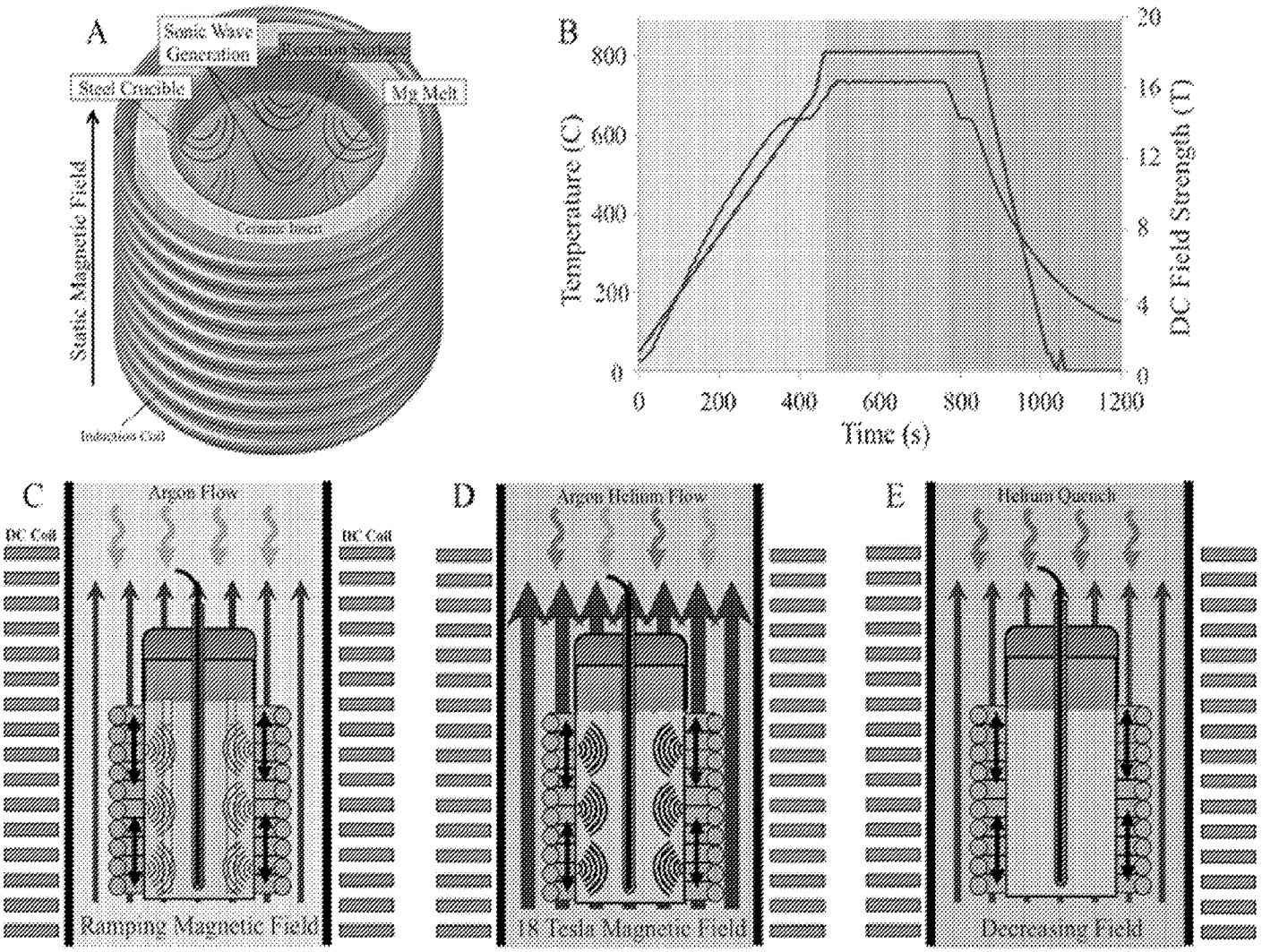
FIG. 2 (A) is a schematic of the MAMT process showing the cylindrical nature of acoustic production and the reaction surface on the interior of the crucible.

Shown schematically in FIG. 2(A), MAMT is a technique that actuates a harmonic mechanical response by the interaction of an alternating and static magnetic field, producing sonic waves. An induction field induces alternating eddy currents in magnesium contained within a stainless steel crucible, heating the sample resistively. An insulating alumina insert protects the induction coil and magnet bore from high temperatures of the crucible, but does not attenuate the induction signal. In addition to heating the sample, induction eddy currents also cross with a large static magnetic field to produce an alternating Lorentz force in the crucible wall and local liquid. This force supplies cylindrical sinusoidal sonication to the contained sample at the induction frequency. With a static magnetic field strength of 10 to 30 Tesla (T), preferably 12 to 20 T, initial acoustic intensities of 50 to 100 $W/cm^2$ can be achieved, which increases as acoustic waves propagate toward the centerline of the crucible by geometric amplification. It is estimated that the cavitation threshold for light metals is in the range of 80-100 $W/cm^2$ causing the entire melt to undergo cavitation. The MAMT process is shown schematically in FIGS. 2(B)-2(E). This technology can be adapted to an interfacial reaction-based particle generation method because the interface (the crucible sides and the melt as shown in the FIG. 2(A) is subjected to equal acoustic intensity throughout. This interface is where particles are produced.

Figure 3:
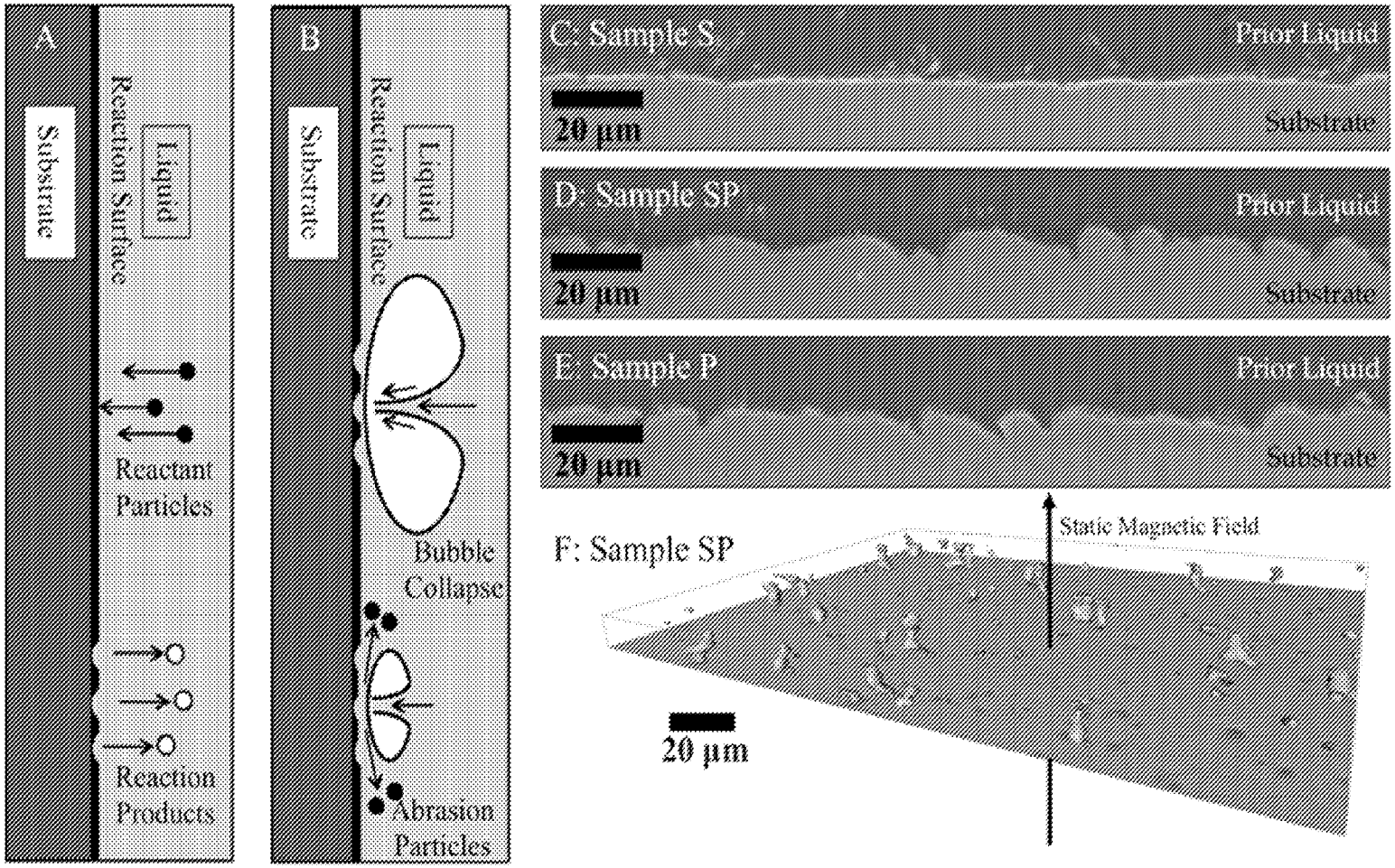
FIG. 3 shows schematics of (A) surface chemical reaction and (B) microjet abrasion. (C) Sample S, (D) Sample SP, and (E) Sample P. S and P received sonic or particle treatment, respectively, while SP received both sonic energy and particles and (F) Tomographic reconstruction of particles in the Mg matrix in Sample SP.

In MAMT, particles are theorized to be produced by two combinatorial mechanisms, as shown in FIG. 3(A) chemical reaction and FIG. 3(B) cavitation abrasion. As reactant particles impinge on the surface and form reaction products, they will commonly leave reaction pits and a rough surface. This roughness will act as a nucleation site for cavitation bubbles. When a cavitation bubble forms in the vicinity of a surface, variations in currents will cause it to collapse asymmetrically, subjecting the surface to a jet of high-speed liquid in a process called microjet formation. This liquid can cause additional abrasion of the surface, and peaks in the surface will act as easy sites of particle generation to this mechanism. These processes may be complementary, as pits formed by reacting particles will increase particle generation by cavitation, leaving smooth surfaces for further particle reaction. If the two mechanisms are combined, cavitation can target reaction pits in the surface and microjet abrasion may remove peaks in the roughened region, enhancing particle production from the surface.

The abrasive particles can be diamonds, cubic boron nitride, steel abrasive, sand, pumice, emery, silicon carbide, aluminum oxide, or the like, or a combination thereof. As noted above, it is desirable for the abrasive particles to contain carbon. Diamonds are the preferred abrasive particles. When the abrasive particles comprise carbon (e.g., diamonds), the abrasive particles may be graphitized. For example, the diamonds are converted to graphitized diamond, which facilitates the production of carbonaceous metal particles during further sonication.

The abrasive particles may be used in amounts of 0.1 to 10 volume percent (vol %), preferably 0.5 to 5 vol % and preferably 1 to 3 vol %, based on the total volume of the abrasive particles and the metallic fluid (e.g. the magnesium).

When the abrasive particles do not contain carbon, it may be desirable to add carbonaceous particles to the abrasive particles. Examples of carbonaceous particles are carbon black, carbon nanotubes, carbon fibers, graphite flakes or lumps (crystalline flake graphite, amorphous graphite, vein graphite), or the like, or a combination comprising at least one of the foregoing carbonaceous particles. In addition to the aforementioned carbonaceous particles or in lieu of carbonaceous particles, non abrasive particles that contain carbon such as iron carbides, silicon carbides, tungsten carbides, or the like, may be added to the container in addition to the abrasive particles. It is desirable for the carbonaceous particles and for the non abrasive particles that contain carbon to react with metals contained in the container to facilitate the formation of alloys during the acoustic cavitation.

It is desirable for the abrasive particles 108 (see FIG. 1) to have average particle sizes of 1 nanometer to 10 micrometers, specifically 10 nanometers to 1 micrometer, and more specifically 20 nanometers to 100 nanometers. In an exemplary embodiment, the abrasive particles 108 are diamond particles having an average particle size of 50 nanometers. The particle size is determined by measuring the diameter of the particles.

With reference again to the FIG. 1, the container 106 may comprise a metal or a ceramic and may contain elements that are desired in the generated nanoparticles. For example, if it is desired to manufacture iron containing nanoparticles, then it is desirable to use an iron crucible, a steel crucible, or a crucible containing another iron alloy. It is also desirable for the container 106 to withstand the temperature of the molten fluid during the process without undergoing melting or deformation itself. The container 106 is sometimes referred to as a crucible and is a sacrificial container. In other words, during sonication, the container is degraded to produce the metal particles having either the composition of the container or to produce particles having a different composition from that of the container. When the metal particles have a different composition from that of the container it may be due to a reaction between the elements contained in the metallic fluid, the elements contained in the abrasive particles and the elements contained in the container.

The container may be manufactured from a pure metal or an alloy. The metals used in the container 106 may be transition metals, alkali metal, alkaline earth metal, lanthanides and actinides, poor metals, or the like, or a combination comprising at least one of the foregoing metals. Examples of metals that may be used in the container are nickel, cobalt, chromium, aluminum, gold, platinum, iron, silver, tin, antimony, titanium, tantalum, vanadium, hafnium, palladium, cadmium, zinc, or the like, or a combination comprising at least one of the foregoing metals.

It is desirable for the container to comprise iron. Steel containers may also be used. Examples of steel that may be used in the container 106 are 300 series steels (303, 303SE, SS 304L, SS 316L and 321), 400 series, chrome steels (52100, SUJ2, and DIN 5401), semi-stainless steels (V-Gin1, V-Gin2, and V-Gin3B), AUSx steels, CPM SxxV steels, VG series, CTS series, V-x series, Aogami/blue series, Shirogame/white series, carbon steels, alloy steels, DSR series, Sandvik series, and the like. In one exemplary embodiment, the container 106 is manufactured from stainless steel and comprises iron, chromium and nickel.

The metallic or ferromagnetic fluid 110 is initially disposed in the container 106 in the form of a solid. The solid may comprise a conductive metal, which can be liquefied via inductive heating while in the container. It is desirable for the metal to have a melting point lower than that of the container. Examples of metals that may be used are magnesium, tin, lead, antimony, manganese, chromium, mercury, cadmium, silver, zinc, zirconium, silicon, or the like, or a combination comprising at least one of the foregoing metals. The metallic fluid or ferromagnetic fluid may be used in amounts of 90 to 99.9 vol %, preferably 95 to 99.5 vol %, and more preferably 97 to 99 vol %, based on the total volume of the abrasive particles and the metallic or ferromagnetic fluid (e.g. the magnesium).

In one embodiment, in one method of using the system 100, the induction coil 104 induces alternating eddy currents by Joule heating. These electric currents interact with an additional perpendicular static magnetic field produced by the magnet 102 to produce an alternating Lorentz force in the sample, leading to acoustic effects and melt sonication. The distribution of induction currents is important to the process, and is described by a surface-dominated mechanism known, as the skin effect. The skin effect is caused by internally opposing current loops generated by an alternating current, and 63% of the induction current is contained within the skin depth. By applying a high magnetic field, smaller alternating currents may be used to generate vibrations, and thus sonication, while maintaining control over Joule heating.

The sonicating facilitates abrasion of the container 106 by the abrasive particles 108. In addition, the abrasive particles or the carbonaceous particles disposed in the fluid may dissolve in the metal fluid or in the container to form a carbonaceous alloy with the metal of the fluid or the metal in the container thus facilitating the formation of different alloys. In addition, the metal fluid may react or combine with metallic elements present in the container or with carbonized metal elements formed as a result of a reaction between carbon and metallic elements in the container or in the metal fluid. These reactions/combinations results in the formation of nanoparticles or microparticles having new compositions.

The sonicating may occur at acoustic frequencies of 200 Hz to 1000 KHz, specifically 1000 Hz to 40 KHz, and more specifically 10 MHz to 20 KHz. The molten fluid is generally heated to temperatures that are sufficient to melt the solid. Exemplary temperatures are 150° C. to 1500° C., specifically 200° C. to 1000° C., and more specifically 300° C. to 900° C. Nanoparticles have average particles sizes of 1 nanometer to up to 1000 nanometers, while microparticles have average particle sizes of greater than 1000 nanometers to 200,000 nanometers.

The method for manufacturing the nanoparticles may be a batch process or a continuous process.

When, for example, diamonds are used as the abrasive particles, with molten magnesium as the metallic fluid and a stainless steel crucible, particles comprising chromium carbide ($Cr_7C_3$), iron carbide ($Fe_3C$), nickel carbide ($Ni_3C$), γ-Fe and magnesium nickel ($MgNi_2$) are formed.

In one embodiment, by permitting the solidification of the molten fluid contained in the container after the particles are produced by sonication, a composite metal alloy may be prepared. For example, if the molten magnesium in the aforementioned example is solidified after the sonication, a composite comprising magnesium metal with chromium carbide ($Cr_7C_3$), iron carbide ($Fe_3C$), nickel carbide ($Ni_3C$), γ-Fe and/or magnesium nickel ($MgNi_2$) particles disposed therein may be produced.

The compositions and the methods disclosed herein are exemplified by the following example.

Example

This example was conducted to demonstrate the manufacturing of nanoparticles. The reaction constituents were chosen to be diamond and 304 stainless steel in the presence of liquid magnesium. Diamond-steel interactions show that diamond quickly transforms to graphite at temperatures above 700° C. in the presence of iron, after which it diffuses into the steel. For stainless steel, this corrosion process proceeds by pitting, making the reaction convenient for this investigation, as pits in stainless steel can act as nucleation sites for cavitation. Since cavitation can only occur in a liquid, a material that is molten at the processing temperature of 750° C. that will not participate in the reaction is needed. Magnesium is used since it melts at 650° C. and exhibits no thermodynamically favorable reactions with Fe or C. Additionally, liquid magnesium is conductive, making it suitable for acoustic generation by MAMT.

The base materials were 99.8% magnesium extruded rod from Strem Chemical and 50 nm aqueous diamond from Advanced Abrasives. The crucibles were produced by attaching 304 stainless steel tubing and sheet by laser welding with no filler. Both materials were supplied by McMaster Carr and meet ASTM A269. The diamond particles were dried on a hot plate and manually crushed prior to other processing. Pre-processing of the samples involved melting the magnesium rod in a stainless steel crucible under argon and letting solidify around a stainless steel thermocouple sleeve. Holes were then drilled in the solidified magnesium, filled with 1 volume percent (vol %) of the diamond nanoparticles, and covered with 99 vol % magnesium (Mg) slugs from Alpha Aesar.

Processing took place at the National High Magnetic Field Laboratory in an 18 Tesla Bitter magnet. A specialized setup, including crucible support, alumina insulation, an induction coil, and argon and helium flow was used inside the bore of the magnet to apply MAMT power. The processing steps were as follows. First, under argon, the induction coil heated the crucible containing the sample while the static magnet ramped to 18 T. The sample melts and reached a processing temperature of 1000K, where it received 2.8 kW of induction energy and was held at the temperature for 5 minutes by mixing helium with the argon. The acoustic pressure at the crucible wall is 2200 kPa. The helium flow was then increased to cool the sample and the induction heater is switched off 20K prior to solidification. The sample solidified and was cooled to complete the process. The process for the sample not processed by MAMT (Sample P) was the same as above, but with no static magnetic field.

Optical tomography images were obtained by a Leica DM2500 and Amira reconstruction software. Scanning Electron Microscopy and Energy Dispersive X-Ray Spectroscopy was conducted on an FEI XL40. Transmission Electron Microscopy was performed on a JEOL 2010f in operating at 200 kV. TEM samples were prepared by standard FIB cross-section techniques.

Magnetic measurements were performed in a Quantum Design MPMS-5 SQUID magnetometer using right cylindrical samples with masses of 40-65 mg. For temperatures below 400 K, the sample was held in a polypropylene straw with a background contribution negligible relative to the samples. M(T) measurements were made at several applied fields (0.1, 0.5, 1 kOe) and isothermal M(H) measurements were made for several temperatures. A second set of measurements from 300 to 750 K using an oven insert were obtained with smaller samples (5-15 mg) inside a custom designed brass tube with quartz spacers to avoid end effects from the brass tube. Data were normalized to the low temperature results using overlapping measurements for samples with and without the furnace between 300 and 350 K.

Three samples were investigated: S (standing for "sonic" treatment only), P (diamond "particle" reactants with no acoustic treatment) and SP ("sonic" treatment with diamond "particle" reactants). Samples P and SP contained 1 vol. % of the diamond seen in FIG. 2(B). Sample P underwent induction melting similarly to Samples S and SP, but with no static magnetic field. Since MMAT uses both induction and static magnetic fields, Sample P received no acoustic treatment.

Figure 4:
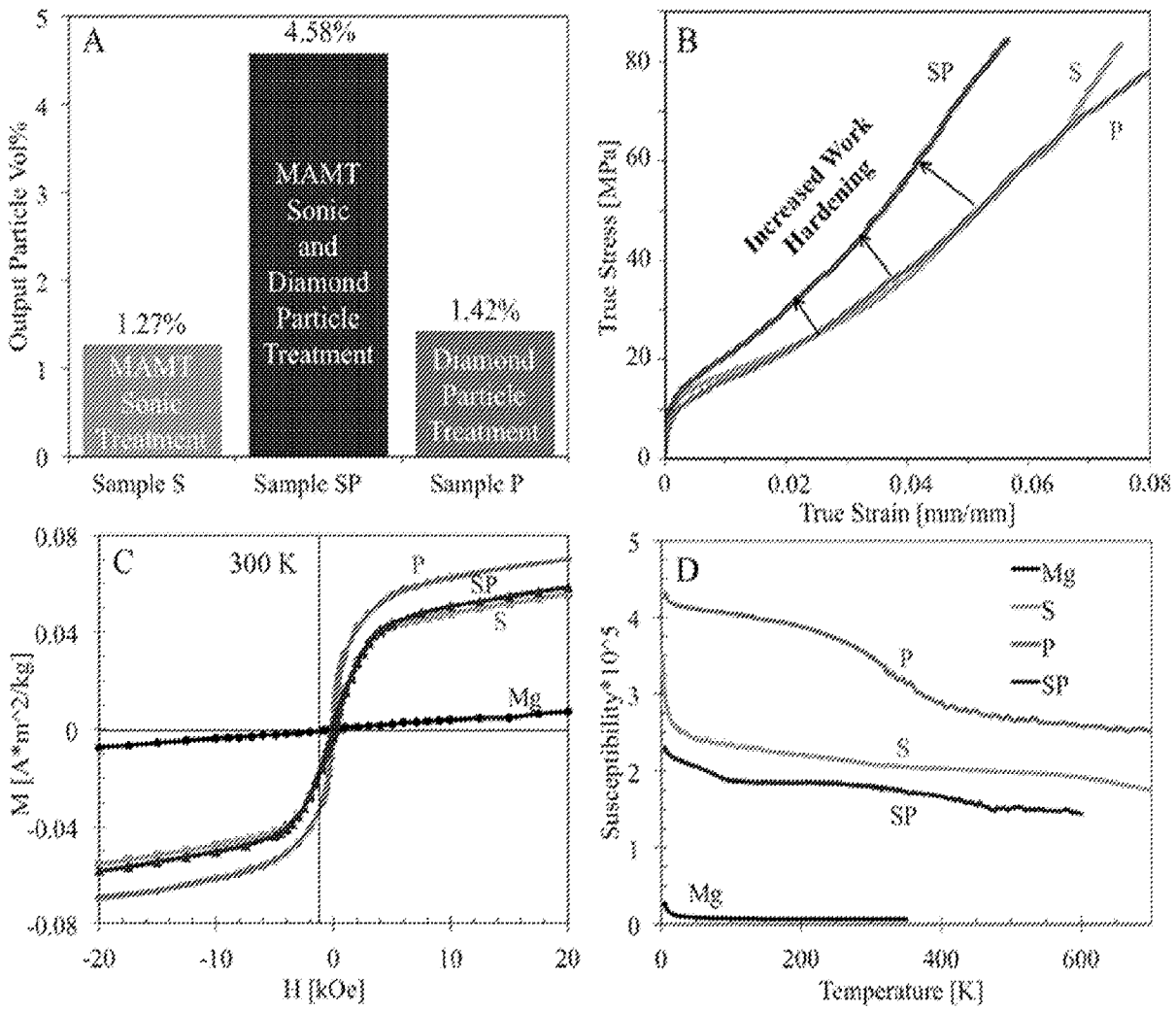
FIG. 4(A) shows volume percentages of particles in three samples, as a function of treatment with sonic energy (Sample S), diamond particles (Sample P), or both (Sample SP)
FIG. 4(B) shows tension curves of Samples S, P, and SP in which SP exhibits a larger work hardening rate.
FIG. 4(C) shows magnetization of magnesium starting material and particle containing samples, the latter of which fit well to a Langevin function, a signature of ferromagnetism, and linear term. Evaluation of the moment as a function of particle volume indicates less than 0.5% of the particles are ferromagnetic.
FIG. 4(D) shows magnetization at 1 kOe. The broad shoulders of the P and SP samples suggest the presence of cementite based alloys $(Fe,Cr)_3C$.

The crucible-melt interfacial roughness (shown in FIGS. 3(C)-3(F) was found to be dependent on sample type. The sample that underwent sonic treatment (Sample S) exhibited a relatively smooth surface, while the samples that contained diamond (P and SP) exhibited a rough surface, regardless of sonic treatment. Quantitatively, the root mean square of the crucible roughness for Sample S was 0.79 μm, for Sample P was 1.30 μm and for Sample SP was 1.50, meaning that Sample S was smoother than P and SP. As previously mentioned, carbon reacts with stainless steel above 700° C. to form reaction pits, which are visible in FIGS. 3(D) and 3(E). The particle volume fractions of the samples (measured by optical microscopy tomography) are shown in FIG. 4(A). From the chart, it can be seen that micron-sized particles were produced in all three samples. Electron Dispersive X-ray Spectroscopy (EDS) analysis of particles in the range of 1-50 μm was conducted and showed that they contain varying ratios of Fe and Cr. No Ni was seen in the μm-sized particles in any of the samples. The Mg—Ni phase diagram shows that Ni will dissolve into molten Mg forming $Mg_2Ni$ and $MgNi_2$ line compounds. Between pure Mg and $Mg_2Ni$ a eutectic forms at 11 atomic percent (at %) Ni and 512° C.

In the samples that were solidified under a static magnetic field (S and SP), the larger particles were mutually aligned in the magnetic field direction, a phenomena caused by mutual dipole-dipole interactions. Particles with diameters of 1-50 μm were resolvable for this measurement. It can be seen that Sample SP contained three times as many particles as either Sample S or P, meaning that particle generation was more effective when both mechanisms shown in FIG. 2 were combined, as opposed to acting independently. Additional evidence of the macro-scale volume fraction of particles is shown in the tension data in FIG. 4(B), in which Sample SP exhibits a higher work hardening rate than either Sample S or P. Since work hardening rate is proportional to the volume fraction of particles, the differences in volume fraction are systematic throughout the material.

Other variables that could affect the work hardening rate, such as alloying additions, grain size (~2 mm), and temperature, were constant across the samples. If the mechanisms from FIG. 1 are active in the system, the diamond particles arrive at the surface and leave pits after reaction products are expelled into the melt. Subsequently, the pits act as nucleation sites for cavitation, enhancing particle formation. Sample SP, in which both reactive and abrasive mechanisms were active, contained 3 times as many particles as S and P, indicating that the two mechanisms are mutually complementary Magnetization data at 300K for the pure Mg starting material and three particle containing samples, as measured by a SQUID magnetometer, is shown in FIG. 4(C). The Mg sample is a linear paramagnet with a magnetic susceptibility, $\chi$=M/H, at 300 K of $1.28\times10^{-5}$, slightly higher than expected for pure Mg ($1.13\times10^{-5}$). In contrast, each of the particle containing samples shows a ferromagnetic (FM) contribution as indicated from the Langevin-like (sigmoid-shaped) magnetization curves. None of the materials displayed significant coercivity—the largest value was 60 (Oerstad) Oe for the SP sample, while the others were <10 Oe. Austenitic 304 stainless steel has a face-centered cubic structure and is paramagnetic at room temperature with a magnetic susceptibility significantly larger than Mg, of order $3\times10^{-3}$. However, cold work can partially transform the structure to a body centered cubic ferritic steel which is ferromagnetic. For a-Fe, the saturation moment is 217 $Am^2/kg$, while the volume normalized moments are 0.78 $A\cdot m^2/kg$, 0.87 $A\cdot m^2/kg$, and 0.23 $A\cdot m^2/kg$ for the S, P, and SP Samples respectively. This corresponds to a ferromagnetic contribution of less than one percent of the particle volume, which when compared to FIG. 4(A), indicates a significant portion of particles in all samples are ferromagnetic.

The magnetization at 1 kOe measured as a function of temperature is shown in the inset of FIG. 4(D) for the four materials. The pure sample shows a low temperature Curie tail consistent with <100 parts per million (ppm) local moment impurities (e.g. Fe, Co, Ni) and no indication of magnetic ordering. The particle containing samples have far larger magnetizations, with several observable features. Both samples with added diamond particles (P, SP) display a broad shoulder between 300 and 500 K, with a loss of about a quarter of the magnetization, while the S sample shows no similar feature. The Curie temperature of cementite ($Fe_3C$) is 481 K and addition of Cr depresses this value. Thus the shoulders observable in the M(T) data suggest a reaction between the graphite particles and stainless steel to form a small amount of $(Fe,Cr)_3C$ in the particle mixture. The absence of a similar feature in Sample S supports this interpretation, as there was no carbon available in the mixture with which the steel particles might react to form cementite. Magnetization measurements made at 600 K, well above these transitions, continues to be dominated by a ferromagnetic signature as suggested from M(T), consistent with the presence of ferritic material such as $\alpha$-Fe ($T_C$=1044 K).

Figure 5:
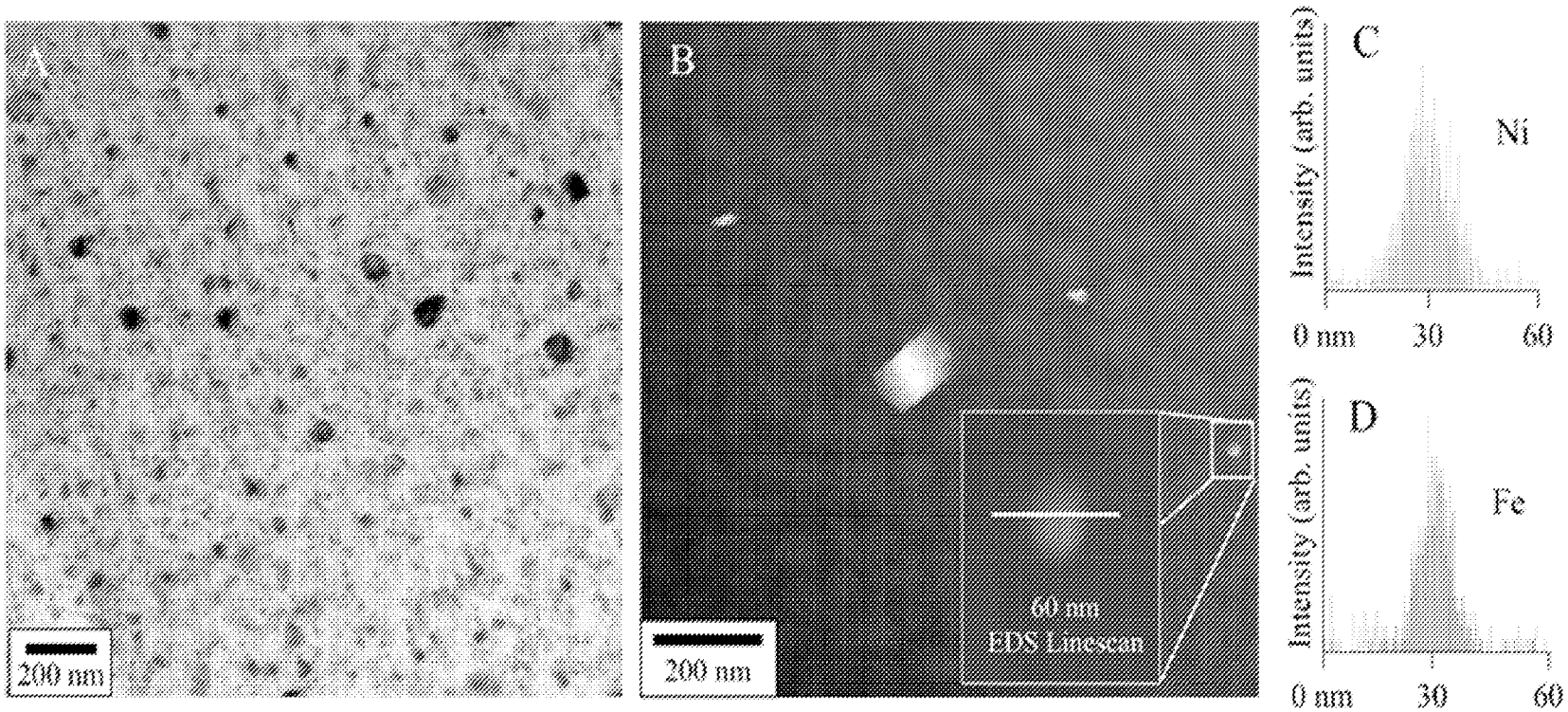
FIG. 5 (A) is a transmission electron micrograph (TEM) bright field image of a group of particles in Sample SP.

In addition to the micron-sized particles in FIG. 3(F), nanoparticles were also produced by the reaction, as shown in FIG. 5. FIGS. 5(A)-5(D) shows TEM analysis of a Fe and Ni-based nanoparticle in Sample SP while FIG. 5(G) shows a nanoparticle in Sample P that was found to be nickel-based. Comparing the two size regimes, Cr was only found in the micron-sized particles, while Ni was only found in the nanoparticles, indicating that different reaction mechanisms are active at the two length scales. Nanoparticles with diameters of 10 nm with a primarily Ni EDS signal were also found in Sample P.

It is to be noted that all ranges detailed herein include the endpoints. Numerical values from different ranges are combinable.

The transition term comprising encompasses the transition terms "consisting of" and "consisting essentially of".

The term "and/or" includes both "and" as well as "or". For example, "A and/or B" is interpreted to be A, B, or A and B.

While the invention has been described with reference to some embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A method comprising:

disposing a container containing a metal and/or ferromagnetic solid and abrasive particles in a static magnetic field; where the container is surrounded by an induction coil;

activating the induction coil with an electrical current, to heat up the metal and/or ferromagnetic solid to form a fluid;

generating sonic energy to produce acoustic cavitation and abrasion between the abrasive particles and the container; and producing nanoparticles that comprise elements from the container, the metal and/or ferromagnetic solid and the abrasive particles.

2. The method of claim 1, where the electric current interacts with the static magnetic field produced to produce an alternating Lorentz force in the container to produce melt sonication in the metal and/or ferromagnetic solid.

3. The method of claim 1, where the container comprises iron, nickel, cobalt, chromium, aluminum, gold, platinum, silver, tin, antimony, titanium, tantalum, vanadium, hafnium, palladium, cadmium, zinc, or a combination comprising at least one of the foregoing metals.

4. The method of claim 1, where the container comprises iron.

5. The method of claim 1, where the container comprises stainless steel.

6. The method of claim 1, where the container comprises iron, chromium and/or nickel.

7. The method of claim 1, where the metal and/or ferromagnetic solid comprises magnesium.

8. The method of claim 1, where the metal and/or ferromagnetic solid comprises magnesium, tin, lead, antimony, manganese, chromium, mercury, cadmium, silver, zinc, zirconium, silicon, or a combination comprising at least one of the foregoing metals.

9. The method of claim 1, where the abrasive particles comprise carbon.

10. The method of claim 9, wherein the container further contains carbonaceous particles in addition to the abrasive particles; where the carbonaceous particles are selected from the group consisting of carbon black, carbon nanotubes, carbon fibers, graphite flakes or lumps, crystalline flake graphite, amorphous graphite, vein graphite, and any combination thereof.

11. The method of claim 1, where the abrasive particles comprise diamond.

12. The method of claim 1, where the abrasive particles do not contain carbon.

13. The method of claim 12, wherein the container further contains carbonaceous particles selected from the group consisting of carbon black, carbon nanotubes, carbon fibers, graphite flakes or lumps, crystalline flake graphite, amorphous graphite, vein graphite, and any combination thereof.

14. The method of claim 1, where the abrasive particles comprise diamonds, cubic boron nitride, steel abrasive, sand, pumice, emery, silicon carbide, aluminum oxide, or a combination thereof.

15. The method of claim 1, further comprising cooling the container and its contents to a temperature that permits solidification of the metal and/or ferromagnetic fluid with the nanoparticles disposed therein.

16. The method of claim 1, where the method is a batch process.

17. The method of claim 1, where the method is a continuous process.

* * * * *